US005606833A

United States Patent [19]

Andersson

[11] Patent Number: 5,606,833

[45] Date of Patent: Mar. 4, 1997

[54] WALL STRUCTURE

[75] Inventor: Leif A. Andersson, Eslöv, Sweden

[73] Assignee: Isover Saint-Gobain, Paris, France

[21] Appl. No.: 295,939

[22] Filed: Aug. 25, 1994

[30] Foreign Application Priority Data

Aug. 27, 1993 [SE] Sweden ..... 9302775

[51] Int. Cl.[6] ..... E04B 2/00

[52] U.S. Cl. ..... 52/506.01; 52/506.05; 52/512; 52/267; 52/293.3

[58] Field of Search ..... 52/506.01, 506.05, 52/512, 267, 274, 293.3

[56] References Cited

U.S. PATENT DOCUMENTS

| | | | |
|---|---|---|---|
| 3,921,355 | 11/1975 | Pennelot | 52/274 X |
| 4,373,304 | 2/1983 | Howitt | 52/293.3 X |
| 4,663,908 | 5/1987 | Kestel, Jr. | 52/274 X |
| 4,744,186 | 5/1988 | Smith et al. | 52/506.01 |
| 5,233,801 | 8/1993 | Wolff | 52/274 X |
| 5,307,600 | 5/1994 | Simon, Jr. et al. | 52/293.3 X |

*Primary Examiner*—Wynn E. Wood
*Attorney, Agent, or Firm*—John Lezdey & Associates

[57] ABSTRACT

A wall structure for interior sound and thermal insulation of rooms. The wall structure comprises at least one insulating member (26*a*, 26*b*, 26*c*) and fastening profiles (10, 28) consisting of metal. These are intended partly for the mutual affixing of members laterally, partly for affixing of each member to floor and ceiling. Especially, each member comprises a soft insulating sheet and a thereto fastened, rigid support sheet. The fastening profiles intended for affixing of the member to floor and ceiling are of L-type and the fastening profiles (28) intended for mutual affixing of members are of T-type. One portion of each L-profile is intended for installation to floor and ceiling respectively and the other for installation in an area between the insulating sheet of the member and its support sheet. The support sheet is intended to face the interior of a room, the two portions of each T-profile projecting on both sides of the main part of the T-profile (28) being intended for positioning in the corresponding areas between insulating sheets and support sheets of members (26*b*, 26*c*) intended for mutual affixing.

9 Claims, 4 Drawing Sheets

WALL STRUCTURE

FIELD OF THE INVENTION

The present invention relates to a wall structure for interior sound and thermal insulation of rooms, comprising at least one insulating member and fastening profiles consisting of metal—partly for the mutual affixing of members laterally, partly for affixing of each member to floor and ceiling.

BACKGROUND OF THE INVENTION

It is previously known to use prefabricated construction members to improve the insulation in connection with building construction. Thus, an insulation is disclosed in for example SE 392 139 comprising a layer of wood-wool concrete insulator boards followed by a layer of mineral wool. The insulation is intended for application on exterior walls, the wood-wool concrete insulator board being connected to the mineral wool by means of a layer of cement grout.

SUMMARY OF THE INVENTION

The object of the present invention is to provide a wall structure of the introductorily mentioned type, which permits simple installation and has good properties as far as sound as well as thermal insulation is concerned. This is accomplished by a wall structure of the type defined by the present invention. The new wall structure is characterized in that each member comprises a soft insulating sheet and a thereto fastened, rigid support sheet, that the fastening profiles for affixing of the member to floor and ceiling are of L-type and that the fastening profiles for mutual affixing of members are of T-type, one portion of each L-profile being intended for installation to floor and ceiling respectively and the other for installation in an area between the insulating sheet of the member and its support sheet, which is to face the interior of the room, the two portions of each T-profile projecting on both sides of the main part of the T-profile being intended for positioning in the corresponding areas between insulating sheets and support sheets of members intended for mutual affixing.

By a soft insulating sheet according to the above is meant a porous sheet having good thermal and sound insulating properties, and by a rigid support sheet is meant a sheet suitable for wall covering with good resistance properties, the support sheet being rigid in relation to the softer insulating sheet.

Preferably, the insulating sheet is made up of a mineral wool sheet of not compressed mineral wool and with a staple fibre layer on the back. Compressed mineral wool may with advantage also be used for the purpose. Preferably, the support sheet is made up of a gypsum sheet giving the member very good sound reducing properties. These are especially evident when the support sheet is fastened to the insulating sheet by means of gluing all over the contact surface with the exception of said areas, which are to be covered by profile parts. Here the member functions as a membrane, and tests, which have been carried out at Tekniska Högskolan in Lund, have shown that surprisingly good sound diminishing properties are obtained. The good diminishing results are due to the fact that the bending resistance of the wall structure by means of the combination of the relatively rigid support sheet and the thereto joined softer insulating sheet is about twice as high seen from the inside of the room as compared with from the bearing wall.

With advantage, the portion of the L-profile, which is intended for installation to floor, comprises at least one flange projecting past the member for affixing to floor by means of a nipple.

The new wall structure according to the above is especially well suited for supplementary insulation, and is above all intended for use in homes. With advantage, the wall structure is mounted loosely to a bearing wall. If desired, however, an air gap can be provided. Possible irregularities in the bedding do not affect the final result.

DESCRIPTION OF PREFERRED EMBODIMENT

Below, the invention will now be described in greater detail with reference to the attached drawings.

Below, the details included in the new wall structure will be described in greater detail in connection with different modes of procedure regarding installation.

A. General installation

Figure 2:
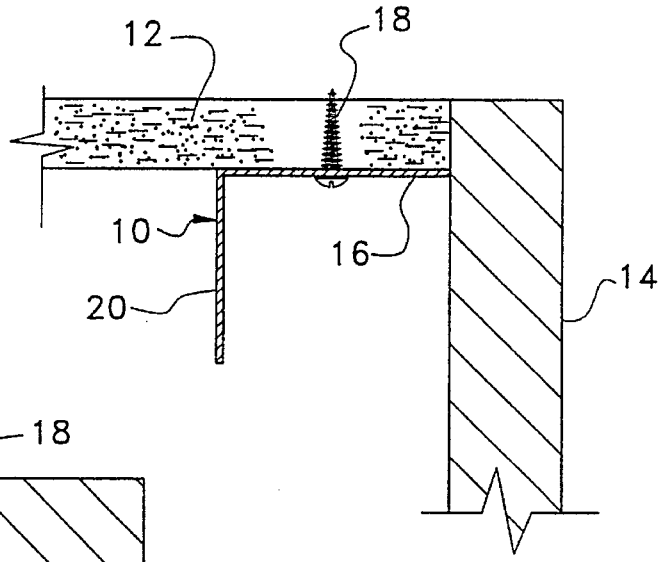
FIG. 2 shows a section of a fastening profile of L-type, which is mounted in a ceiling adjacent to a wall for installation of insulating members.
Figure 3:
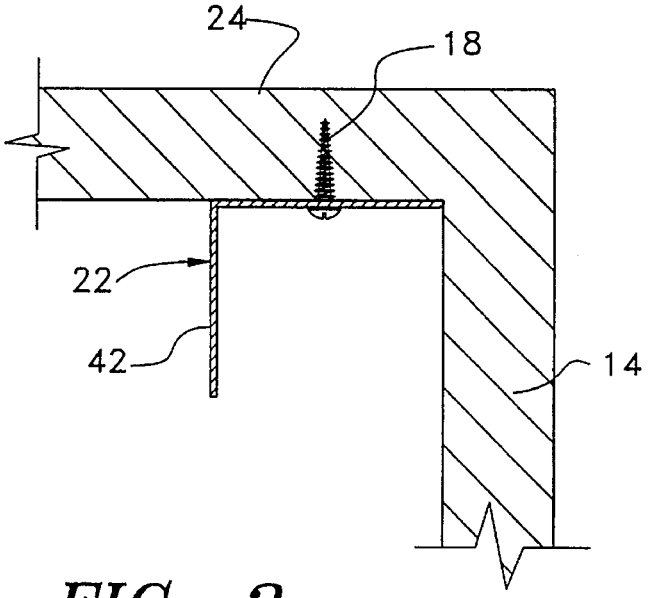
FIG. 3 shows a section of a fastening profile of L-type, which can be used in connection with installation of insulating members adjacent to an inner corner of a room.
Figure 6:
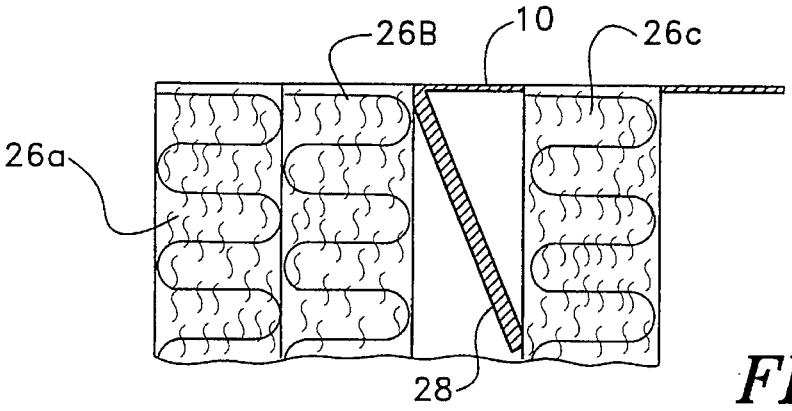
FIG. 6 is a bottom view from the front showing how an insulating member is joined to another insulating member by means of the pans being part of the wall structure.

1. A fastening profile 10 of L-type is affixed (see FIG. 2) to the ceiling 12 of a room, where a wall 14 is to be completed by means of the new wall structure. One portion 16 of the L-profile 10 is in this connection applied in immediate contact with the ceiling 12. For this purpose, for example, a nail punch, screw 18 together with plug or nail are used. The distance between the wall 14 and the other downwards facing portion 20 of the L-profile must be at least equal to the thickness of the insulating sheet.
2. The position for a further, possibly existing L-profile 22, intended for vertical positioning on an adjoining wall 24, is plumbed with a guide line for correct attachment of the insulating member at the floor.
3. The L-profile 22 is mounted in the adjoining wall 24 with the aid of said plumbline. For example, the installation is done by using a nail punch, screw 18 together with plug or nail (see FIG. 3).
4. An insulating member 26 is cut into the right length for covering of the intended wall between floor and ceiling. A fastening profile 28 (see FIG. 6) of T-type is now also cut off for adjustment to said insulating member 26.

Figure 1:
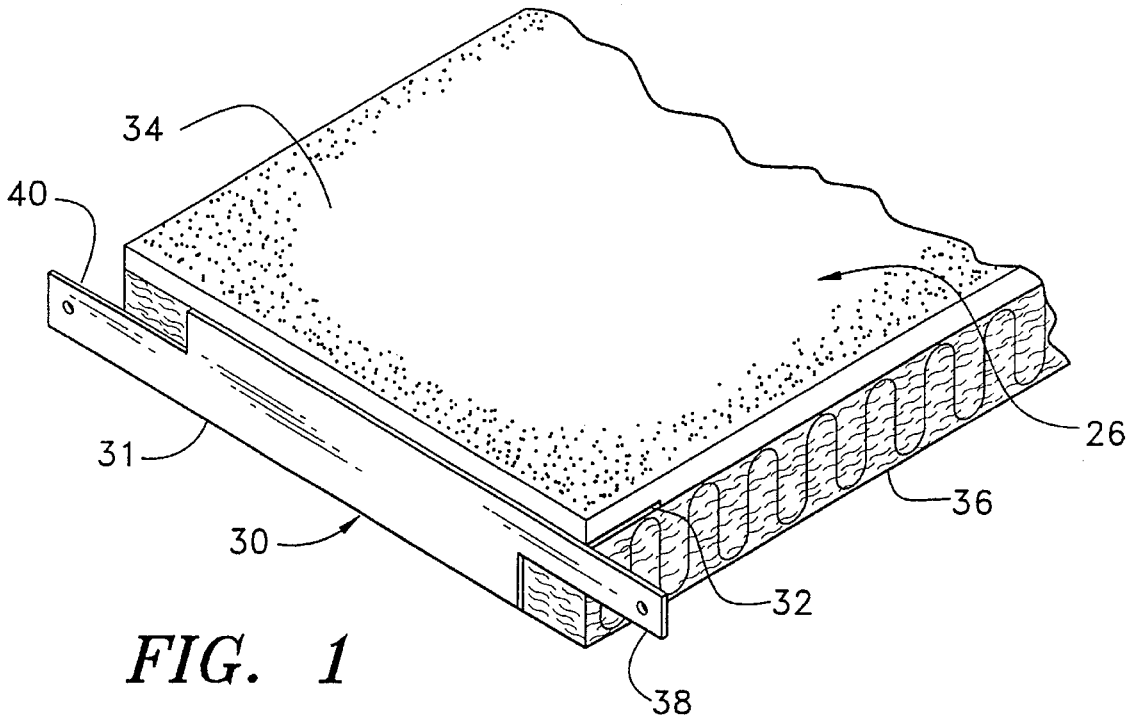
FIG. 1 shows perspectively a part of an insulating member together with a thereto belonging fastening profile, which is intended for installation to a floor.

5. A short fastening member 30 of L-type is positioned at the lower edge of the insulating member 26 (see FIG. 1). In this connection, one portion 32 of the L-profile 30 is entered between the gypsum sheet 34 and the mineral wool sheet 36 in an area, where said sheets are not glued together. The other portion 31 will contact the floor. As is also clear from FIG. 1, the L-profile at its opposite ends is provided with flanges 38, 40 in a displaced arrangement, which extend past the member 26.

Figure 4:
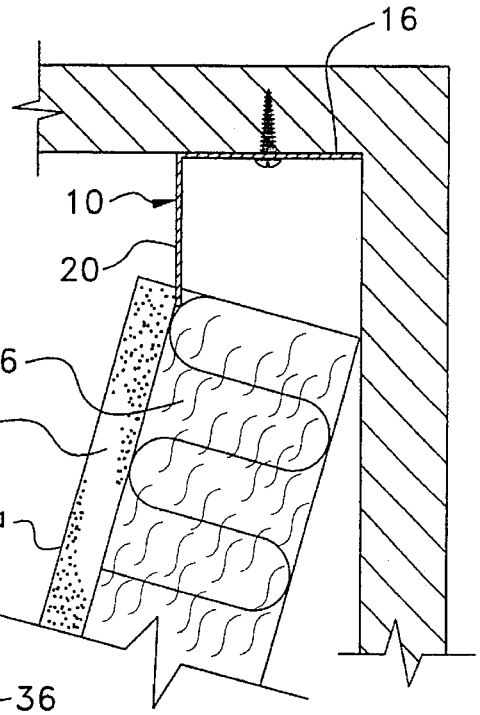
FIG. 4 shows the arrangement according to FIG. 2, an insulating member being connected to the L-profile.
Figure 5:
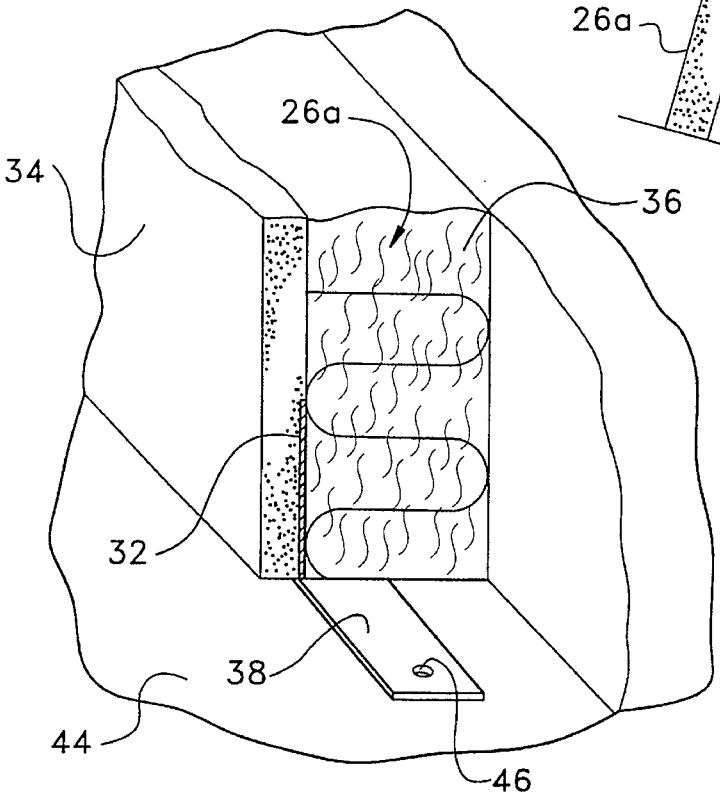
FIG. 5 is a perspective and partly sectional view of the affixing of an insulating member to a floor.

Regarding installation of the first member 26*a* adjacent an adjoining wall 24, the flange 40 is cut off at that side of the member, which is to be placed adjacent the adjoining 24. The insulating member 26*a* is now placed in such a manner (see FIG. 4) that the L-profile 10 which is located adjacent to the ceiling with its portion 20 will enter between the mineral wool sheet 36 and the gypsum sheet 34. The distance between the first member 26*a* and the adjoining wall 24 is in this case about 60–70 mm. The member 26*a* is checked with respect to its vertical position and is then moved laterally towards the adjoining wall 24, so that the corresponding portion 42 of the L-profile 22 of the adjoining wall 24 will enter between the mineral wool sheet 36 and the gypsum sheet 34. Then the insulating member 26*a* is affixed to the floor 44 by means of a nipple 46 adjacent to the projecting flange 38 (cf. FIG. 5).

In connection with installation of each of the following members (e.g. 26*c*) said member is placed about 200 mm from a previous member 26*b* with the portion pointed downwards 20 of the ceiling profile 10 placed between the gypsum sheet 34 and the mineral wool sheet 36. A T-profile 28 is pushed up to the L-profile 10 in the ceiling (for this purpose, the T-profile is provided with a corresponding recess) and is fitted in such a manner that its upper edge enters (see FIG. 6) in the space between the mineral wool sheet 36 and gypsum sheet 34 in the upper edge of the previous member 26*b*. In this connection, the lower edge of the T-profile 28 is entered between the mineral wool sheet 36 and the gypsum sheet 34 in an unglued area in the lower edge of the insulating member 26*c*. The insulating member 26*c* can now under control be moved towards the previous member 26*b* for final contact close thereto. The projecting flange 38 is fastened with screws to the floor 44 in the same manner as has been described for the first member 26*a*.

6. After completed installation according to the above all members are fastened with screws in their corresponding fastening profiles, which with advantage are made of steel. The screw distance should be about 200 mm.

B. Installation adjacent to an inner corner

Figure 7:
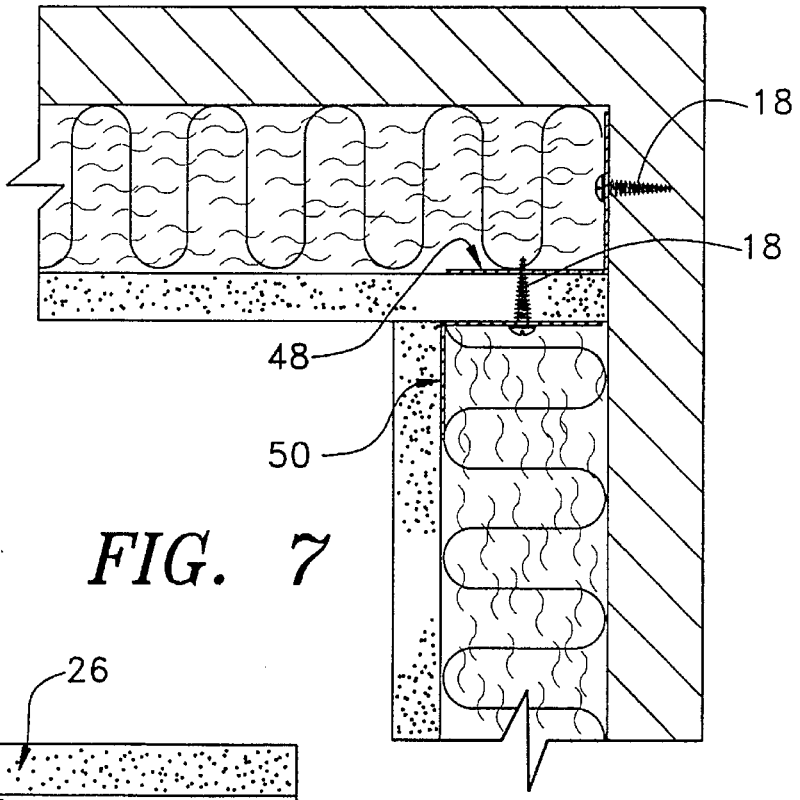
FIG. 7 shows a section of an arrangement for installation of insulating members at an inner corner of a room.

A mode of procedure for installation adjacent to an inner corner is clear from FIG. 7 on the drawing. As is shown, vertically located L-profiles 48, 50 and screws 18 are again used.

C. Installation adjacent to an outer corner

Figure 8:
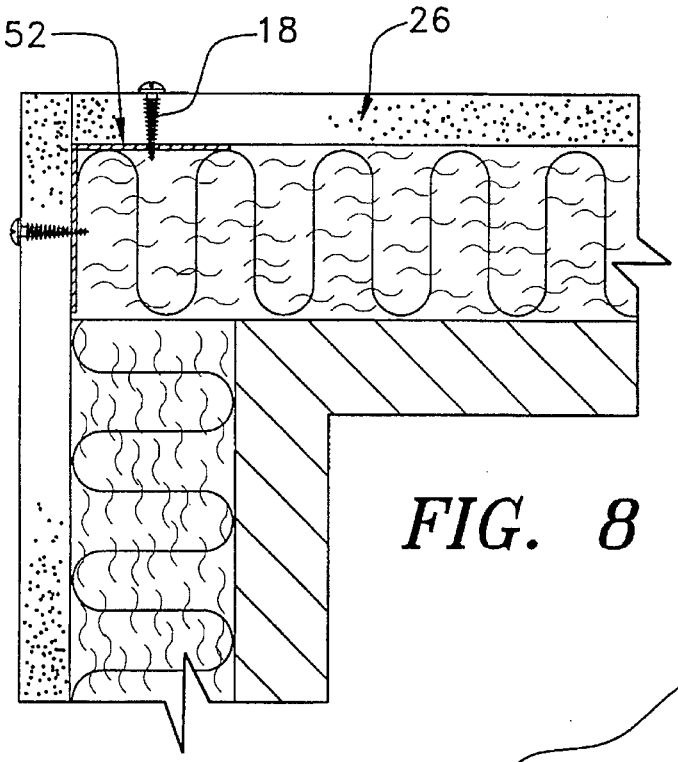
FIG. 8 shows a section of an installation of insulating members at an outer corner of a room.

Also in connection with installation of insulating members 26 adjacent to an outer corner of a room, a vertically located L-member 52, as is especially clear from FIG. 8, together with screws 18 are made use of.

D. Installation adjacent to a window or door

Figure 9:
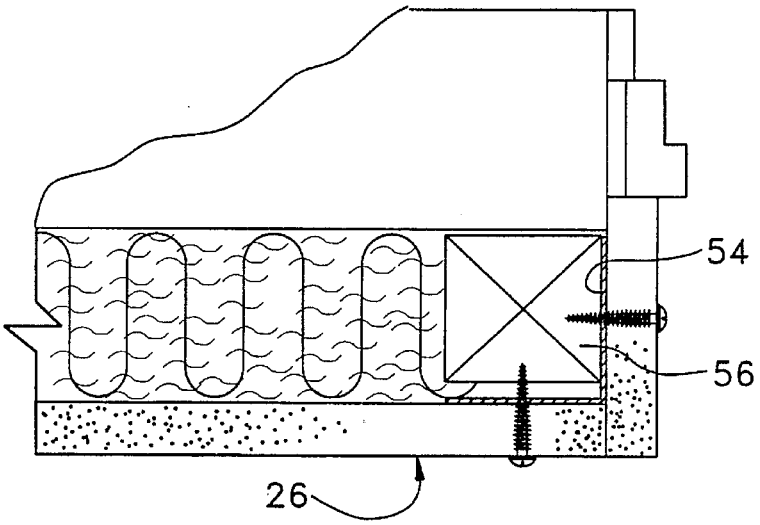
FIG. 9 shows a section of the installation of an insulating member adjacent to an adjoining window or door.
Figure 10:
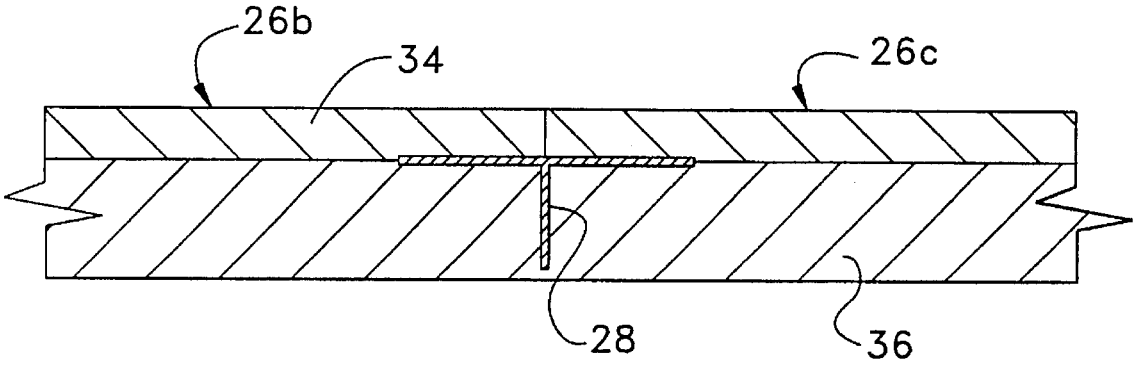
FIG. 10 shows a section of the instalation of insulating members having a T-type connection located between two insulating members.

As is clear from FIG. 9, here too a vertically located L-profile 54 is used, the portion of an insulating member 26 adjoining the window/door being reinforced by means of a vertical wooden crossbar 56, together with nails or screws 18.

It is understood, that the above stated assembly instructions are only intended to be an example. Variations may be made within the scope of what is offered by the members of the defined wall structure included in the claims.

I claim:

1. A wall structure for interior sound and thermal insulation of a room, said wall structure comprising at least one prefabricated insulating member and fastening means, said fastening means consisting of metal for affixing said insulating member laterally to a wall, and for affixing said insulating member to a floor and a ceiling, said insulating member including at least two sheets fastened together, said sheets including a soft insulating sheet and a rigid support sheet such that said insulating member has a bending resistance inside of said room that is higher than the bending resistance of said insulating member at said wall, said fastening means including at least two types, said fastening means types including a L-type and a T-type, said L-type fastening means being used for affixing said insulating member to said floor and said ceiling, and said T-type fastening means being used for affixing said insulating member laterally to said wall, a portion of said L-type fastening means being used for installation to said floor and said ceiling, wherein the portion of the L-type fastening means that is intended for installation to the floor comprises at least one flange projecting past the fastening means and a nipple for affixing to the floor, and another portion of said L-type fastening means being used for installation in an area between said insulating sheet and said support sheet, said support sheet being positioned to face the interior of said room, and two portions of said T-type fastening means being used for positioning in the corresponding areas between said insulating sheet and said support sheet.

2. A wall structure according to claim 1 wherein the insulating sheet comprises a mineral wool sheet.

3. A wall structure according to claim 2 wherein the mineral wool of the insulating sheet is not compressed.

4. A wall structure according to claim 2 wherein the support sheet comprises a gypsum sheet.

5. A wall structure according to claim 1 wherein the support sheet is fastened to the insulating sheet by gluing the contact surface with the exception of an area to be covered by the fastening means.

6. A wall structure according to claim 1 further comprising screws for joining together the members and fastening means by screwing from the outside of the support sheet.

7. A wall structure according to claim 1 further comprising additional L-type fastening means for vertical positioning and affixing the insulating members at corners of the room.

8. A method for insulating an enclosure for sound and temperature comprising affixing to said enclosure a wall structure according to claim 1.

9. A wall structure according to claim 1, wherein the bending resistance of said insulating member inside of said room is twice as high as the bending resistance of said insulating member at said wall.

* * * * *